US008471444B2

(12) United States Patent
Van Spijker

(10) Patent No.: US 8,471,444 B2
(45) Date of Patent: Jun. 25, 2013

(54) ION BARRIER MEMBRANE FOR USE IN A VACUUM TUBE USING ELECTRON MULTIPLYING, AN ELECTRON MULTIPLYING STRUCTURE FOR USE IN A VACUUM TUBE USING ELECTRON MULTIPLYING AS WELL AS A VACUUM TUBE USING ELECTRON MULTIPLYING PROVIDED WITH SUCH AN ELECTRON MULTIPLYING STRUCTURE

(75) Inventor: Jan Van Spijker, Roden (NL)

(73) Assignee: Photonis Netherlands B.V., Roden (NL)

( * ) Notice: Subject to any disclaimer, the term of this patent is extended or adjusted under 35 U.S.C. 154(b) by 152 days.

(21) Appl. No.: 12/559,109

(22) Filed: Sep. 14, 2009

(65) Prior Publication Data

US 2010/0066245 A1 Mar. 18, 2010

Related U.S. Application Data

(60) Provisional application No. 61/097,032, filed on Sep. 15, 2008.

(51) Int. Cl.
*H01J 43/00* (2006.01)

(52) U.S. Cl.
USPC ..... 313/103 CM; 313/532; 313/103 R

(58) Field of Classification Search
USPC ..... 313/103 R, 103 CM, 104, 105 R, 313/105 CM, 532; 250/206–207, 214 R, 250/214 A, 214 VT
See application file for complete search history.

(56) References Cited

U.S. PATENT DOCUMENTS

| | | | | |
|---|---|---|---|---|
| 3,603,832 | A | 9/1971 | Manley | |
| 4,625,106 | A | 11/1986 | Bender et al. | |
| 5,164,582 | A | 11/1992 | Boskma | |
| 6,482,553 | B1 | 11/2002 | Gottert et al. | |
| 2005/0151054 | A1 * | 7/2005 | Syms | 250/207 |
| 2006/0081770 | A1 | 4/2006 | Buchin | |
| 2008/0272280 | A1 * | 11/2008 | Pinkas et al. | 250/214 VT |
| 2009/0321633 | A1 * | 12/2009 | Blick et al. | 250/307 |

* cited by examiner

*Primary Examiner* — Donald Raleigh
(74) *Attorney, Agent, or Firm* — Muncy, Geissler, Olds & Lowe, PLLC

(57) ABSTRACT

An electron multiplying structure for use in a vacuum tube using electron multiplying comprises an input face to be oriented in a facing relationship with an entrance window of the vacuum tube, an output face to be oriented in a facing relationship with a detection surface of the vacuum tube, as well as an ion barrier membrane for shielding off stray ions. The vacuum tube uses electron multiplying having a photocathode capable of releasing electrons into the vacuum chamber when exposed to light, electric field device for accelerating the released electrons from the photocathode towards an anode spaced apart from the photocathode in a facing relationship, as well as an electron multiplying structure. An ion barrier membrane is used in a vacuum tube and/or an electron multiplying structure. The ion barrier membrane is composed of at least one atomic layer containing graphene.

12 Claims, 5 Drawing Sheets

Figure 1:
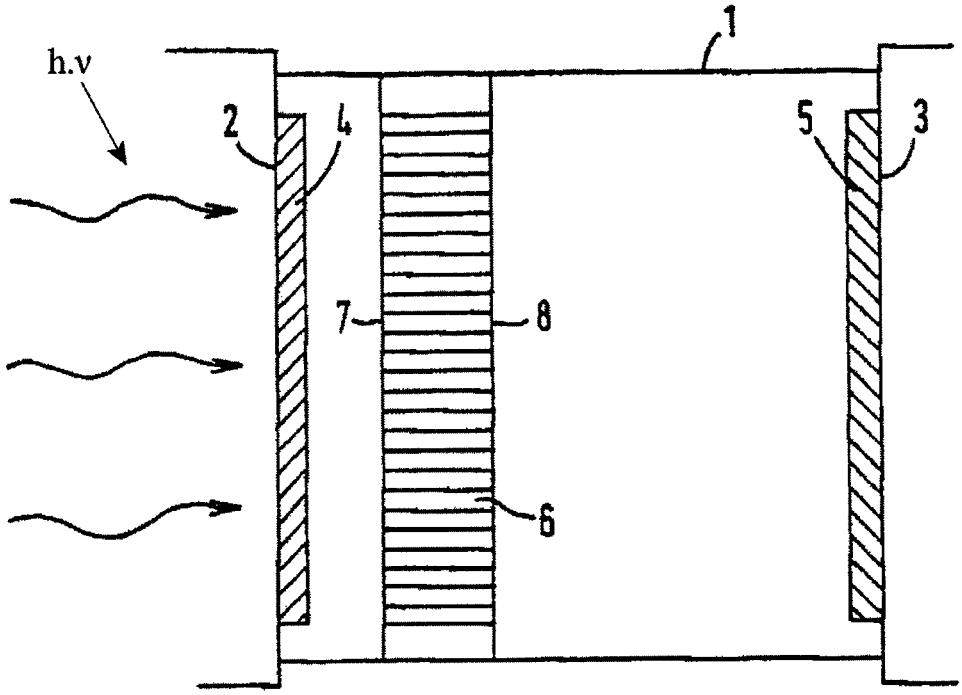

ION BARRIER MEMBRANE FOR USE IN A VACUUM TUBE USING ELECTRON MULTIPLYING, AN ELECTRON MULTIPLYING STRUCTURE FOR USE IN A VACUUM TUBE USING ELECTRON MULTIPLYING AS WELL AS A VACUUM TUBE USING ELECTRON MULTIPLYING PROVIDED WITH SUCH AN ELECTRON MULTIPLYING STRUCTURE

This application claims priority of Provisional Application No. 61/097,032, filed Sept. 15, 2008 under 37 C.F.R. 1.53(c).

The invention relates to an electron multiplying structure for use in a vacuum tube using electron multiplying, the electron multiplying structure comprising an input face intended to be oriented in a facing relationship with an entrance window of the vacuum tube, an output face intended to be oriented in a facing relationship with a detection surface of the vacuum tube, as well as an ion barrier membrane for shielding off stray ions.

The invention also relates to an vacuum tube using electron multiplying having a photocathode capable of releasing electrons into said vacuum chamber when exposed to light, electric field means for accelerating said released electrons from said photocathode towards an anode spaced apart from said photocathode in a facing relationship, as well as an electron multiplying structure according to the invention disposed in said vacuum chamber between said photocathode and said anode.

The invention also relates to an ion barrier membrane for use in a vacuum tube and/or an electron multiplying structure according to the invention.

Please note that in this application vacuum tube structures using electron multiplying comprise—amongst others—image intensifier tube devices, open faced electron multipliers, channeltrons, microchannel plates and also sealed devices like image intensifiers and photomultipliers that incorporate elements or subassemblies like discrete dynodes and microchannel plates that use the phenomenon of secondary emission as a gain mechanism. Such vacuum tubes are known in the art. They comprise a cathode which under the influence of incident radiation, such as light or X-rays, emits so-called photo electrons which under the influence of an electric field move towards an anode. The electrons striking the anode constitute an information signal, which signal is further processed by suitable processing means.

In modern image intensifier tubes an electron multiplying structure, mostly a microchannel plate or MCP for short, is placed between the cathode and the anode to increase the image intensification. In the case that the electron multiplying structure is constructed as a channel plate, the channel plate comprises a stack of hollow tubes, e.g. hollow glass fibres, extending between an input face and an output face. A (voltage) potential difference is applied between the input face and the output face of the channel plate, such that an electron entering a channel at the input face moves in the direction of the output face, in which displacement the number of electrons is increased by secondary emission effects. After leaving the channel plate at the output face these electrons (primary electrons and secondary electrons) are accelerated in the usual manner in the direction of the anode.

In each of these devices, there is an associated phenomenon that is commonly referred to as 'ion feedback'. This phenomenon occurs when (negatively charged) electrons that have acquired sufficient kinetic energy in the accelerating electric field strike and ionise atoms or molecules still present in the vacuum chamber or adsorbed at the surfaces stricken by the electrons.

Once the neutral gas atom or molecule has been positively charged by the electron impact that knocked an electron from the outer region of the atom's electron cloud, the ions are subjected to the same electric field but, due to their positive charge, will move in the opposite direction, acquiring kinetic energy and striking surfaces at the input side of the device.

These ion feedback impacts are quite often very noticeable and on most instances disturb or reduce the signal outputted by the device by so-called after-pulses or ion spots in the image of the device. In many of the prior art devices, special care is given to the design, the construction or the limitation in operating pressure range or operating voltages to avoid or reduce the effects of ion feedback.

As a solution, in particular in image intensifier tube devices having component surfaces made from or contain vulnerable mono-atomic negative electron affinity layers, like for example GaAs with a Cs-based surface layer, a so-called ion barrier membrane is disposed in the vacuum chamber in order to shield off those component surfaces from the stray ions. Such membrane will prevent that such stray ions will permanently damage and reduce the photocathode's emissive quantum efficiency.

An essential drawback of such an ion barrier membrane is that it not only blocks the feedback of stray ions, but it also considerably reduces the amount of primary electrons that can be considered to carry the signal or image information in the device towards the anode. Practical considerations of strength, desired permeability for electrons and desired impermeability for ions have lead to most common thicknesses of ion barrier membranes of several tens of nanometer using materials such as $Al_2O_3$ or $SiO_2$ or other compounds having a low atomic mass.

It is an object of the invention is to provide an electron multiplying structure having an improved performance in term of shielding capabilities against stray ions and reduced loss of emitted electrons. For this purpose, the electron multiplying structure according to the invention is characterized in that said ion barrier membrane is composed of at least one atomic layer containing graphene.

Graphene is a one-atom-thick planar sheet of carbon atoms having a hexagonal crystal lattice and can be construed as a membrane shielding off the fragile or vulnerable component surfaces of vacuum tubes using electron multiplying against stray ions. In particular it has proven that a mono-atomic thickness graphene layer is impermeable for stray ions and thus can serve as an efficient ion barrier membrane.

Furthermore due to the fact that a mono-atomic membrane of carbon atoms, such as graphene, can be construed in a very thin membrane layer it has a significant low loss of electrons. Therefore it will have the best detective quantum efficiency (DOE) in devices where it will be used to block 'stray' ion feed back.

The shielding off capabilities of the ion barrier membrane according to the invention can be further improved or otherwise influenced as according to the invention said ion barrier membrane is composed of multiple atomic layers containing graphene.

More specifically said at least one atomic layer solely contains graphene.

In a specific embodiment of the invention said ion barrier membrane is placed at the input face of the electron multiplying structure, whereas in another embodiment said ion barrier membrane is placed at the output face of the electron multiplying structure.

In yet another embodiment said electron multiplying structure is arranged to support the entrance windows of said vacuum tube.

In a further embodiment said electron multiplying structure is constructed as a channel plate, in particular a microchannel plate, whereas in another embodiment said electron multiplying structure is constructed as an array of secondary electron emitting dynodes.

In a further aspect of the invention the vacuum tube using electron multiplying as an image intensifier tube, whereas in another embodiment said vacuum tube is constructed as a photo multiplier tube.

Also embodiments wherein said vacuum tube is constructed as a channeltron or as a microchannel plate detector are advantageous over the prior art devices.

Figure 2:
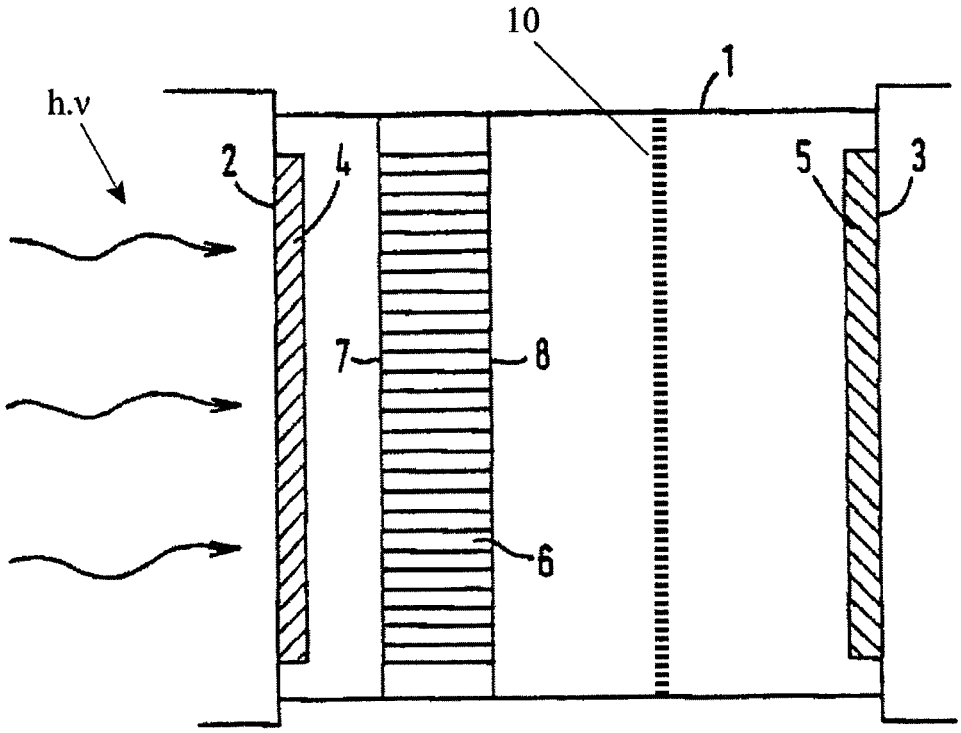
Figure 3:
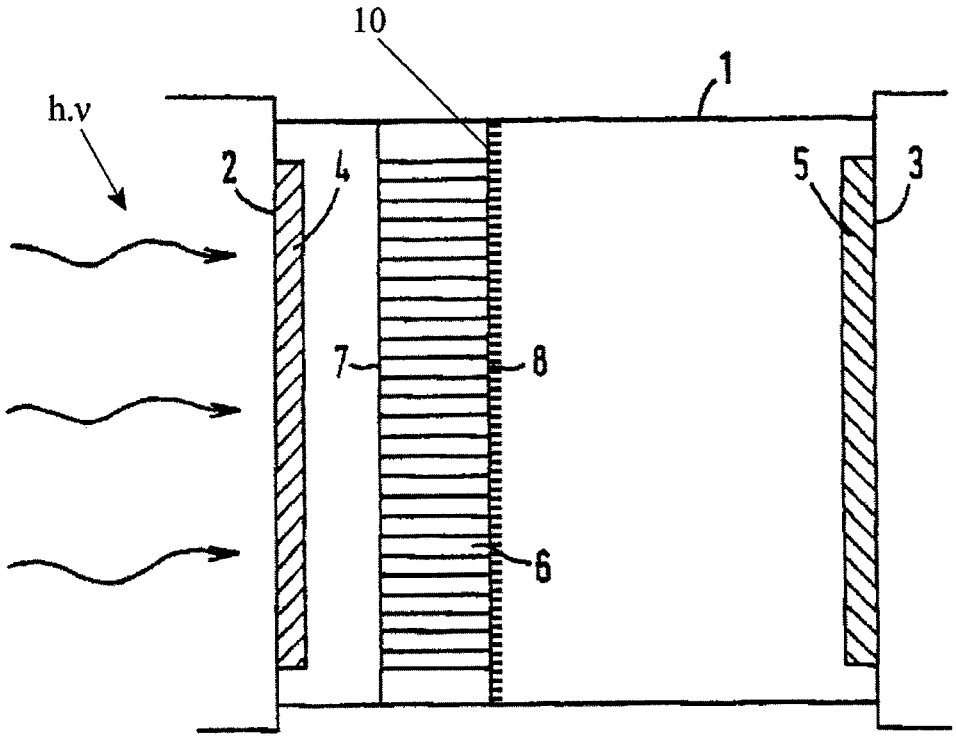
Figure 4:
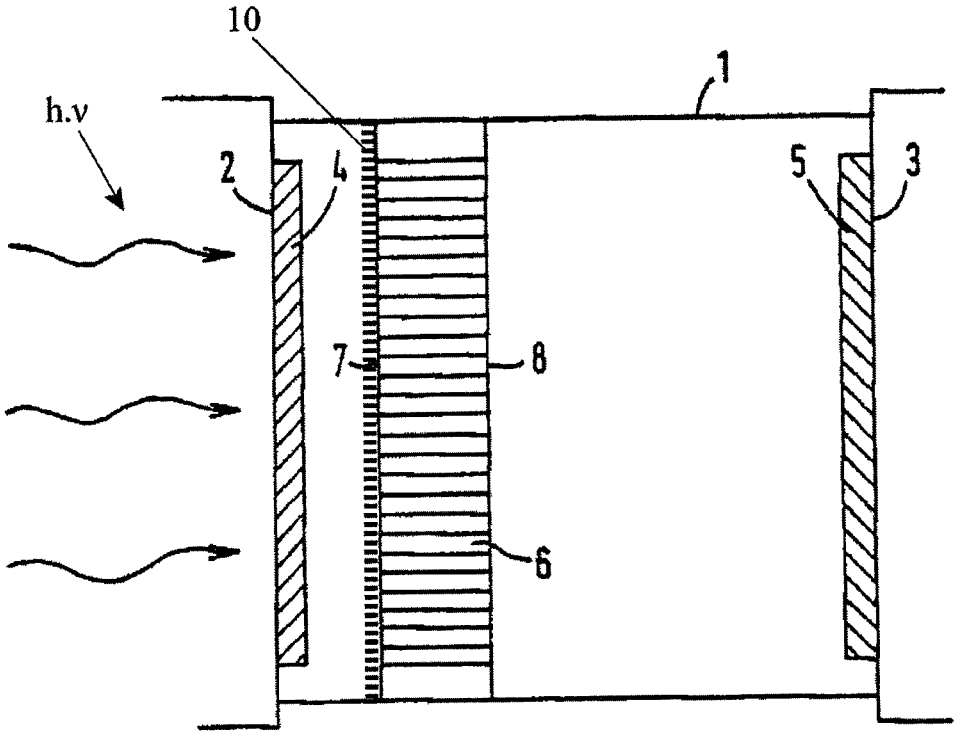
Figure 5:
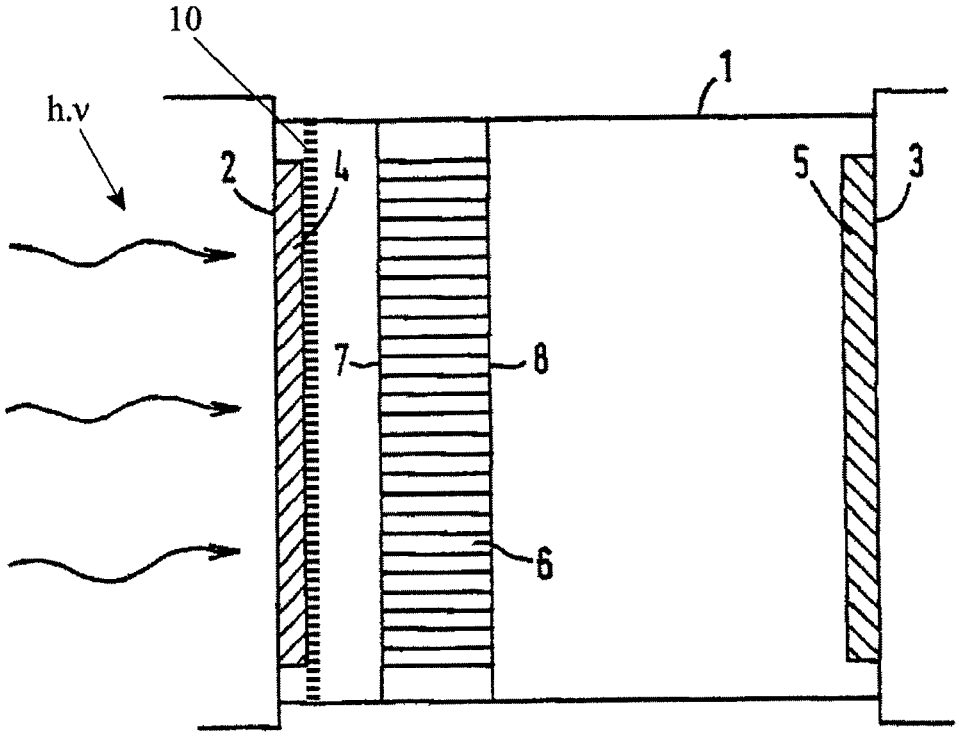

The invention will be explained in greater detail below with reference to the appended drawing, which shows in:

FIG. 1 a vacuum tube provided with an electron multiplying structure according to the state of the art;

FIG. 2 a first embodiment of a vacuum tube using electron multiplying with an electron multiplying structure according to the invention;

FIG. 3 a second embodiment of a vacuum tube using electron multiplying with an electron multiplying structure according to the invention;

FIG. 4 a third embodiment of a vacuum tube using electron multiplying with an electron multiplying structure according to the invention;

FIG. 5 a fourth embodiment of a vacuum tube using electron multiplying with an electron multiplying structure according to the invention;

For the sake of clarity in the following detailed description all like parts are denoted with the same reference numerals.

FIG. 1 shows schematically, in cross section, an example of an vacuum tube, for example an image intensifier. The image intensifier tube comprises a tubular housing 1 having an entrance or cathode window 2 and a detection or anode window 3. The housing can be made of glass, as can the cathode window and the anode window. The detection window 3 is, however, also often an optical fibre plate or constructed as a scintillating screen or as a pixilated array of elements (such as a semiconductor active pixel array). The housing can also be made of metal, in the event of the cathode and possibly the anode being arranged in an insulated manner in the housing, for example by using a separate carrier.

If the image intensifier is designed for receiving X-rays, the cathode window can be made of a thin metal. The anode window can, however, be light-transmitting. The cathode 4 can also be provided directly on the input face 7 of the channel plate 6. All such variants are known per se and are therefore not shown in greater detail.

In the example shown the actual cathode 4 is on the inside of the entrance window 2 and emits electrons under the influence of incident light or x-rays (indicated in FIGS. 1-5 with "h.v"). The emitted electrons are propelled in a known manner under the influence of an electric field (not shown) in the direction of an anode 5 disposed on the inside of the detection window 3.

An electron multiplying structure in this embodiment constructed as a channel plate 6 extending approximately parallel to cathode 4 and anode 5 is placed between cathode and anode. A large number of tubular channels, which can have a diameter, e.g., of the order of 8-12 μm, extend between the input face 7 of the channel plate facing the entrance window 2 (cathode 4) and the output face 8 of the channel plate facing the detection surface 3 (anode 5).

As mentioned in the introductionary part the phenomenon 'ion feedback' disturb or reduce the signal outputted by the device by so-called after-pulses or ion spots in the image of the device. In many of the prior art devices, special care is given to the design, the construction or the limitation in operating pressure range or operating voltages to avoid or reduce the effects of ion feedback.

This phenomenon occurs when (negatively charged) electrons that have acquired sufficient kinetic energy in the accelerating electric field strike and ionise atoms or molecules still present in the vacuum chamber or adsorbed at the surfaces stricken by the electrons, here the anode 5 and the detection window 3.

According to the invention and as disclosed in FIGS. 2-5 the electron multiplying structure 6 comprises an ion barrier membrane 10, which is composed of at least one atomic layer containing graphene.

Please note that for solely illustrative purposes the atomic layer graphene ion barrier membrane is depicted as a thick line.

Graphene is a one-atom-thick planar sheet of carbon atoms having a hexagonal crystal lattice and can be construed as a membrane shielding off the fragile or vulnerable component surfaces of vacuum tubes using electron multiplying against stray ions. In particular it has proven that a mono-atomic thickness graphene layer is impermeable for stray ions moving from the detection windows 3 (5) in the direction of the electron multiplying structure 8 and the entrance window 2 (4) due to the applied electric field. A graphene mono-atomic layer thus can serve as an efficient ion barrier membrane.

Furthermore due to the fact that a mono-atomic membrane of carbon atoms, such as graphene, can be construed in a very thin membrane layer it has a significant low loss of electrons moving from the entrance windows 2 (4) and the electron multiplying structure 8 towards the entrance window 3 (5) due to the applied electric field. Therefore it will have the best detective quantum efficiency (DQE) in devices where it will be used to block 'stray' ion feed back.

The shielding off capabilities of the graphene ion barrier membrane 10 can be further improved or otherwise influenced by composing said ion barrier membrane 10 from multiple atomic layers containing graphene.

In one embodiment said graphene ion barrier membrane 10 can be positioned between the anode 5/detection window 3 and said output face 8 of the electron multiplying means 6 (FIG. 2).

In another embodiment (FIG. 3) said graphene ion barrier membrane 10 is applied on said output face 8 of the electron multiplying means 6.

In yet another embodiment (FIG. 4) said graphene ion barrier membrane 10 is applied on said input face 7 of the electron multiplying means 6, whereas in yet another embodiment (FIG. 5) said graphene ion barrier membrane 10 is applied on (or supports) the inner side of the entrance window 2 and more in particular on the cathode 4.

The invention claimed is:

1. An electron multiplying structure for use in a vacuum tube using electron multiplying, the electron multiplying structure being constructed as a microchannel plate, and comprising an input face intended to be oriented in a facing relationship with an entrance window of the vacuum tube, an output face intended to be oriented in a facing relationship with a detection surface of the vacuum tube, as well as an ion barrier membrane for shielding off stray ions, wherein said ion barrier membrane is composed of at least one atomic layer containing graphene and said ion barrier membrane is placed on the input face of the electron multiplying structure.

2. Electron multiplying structure according to claim 1, wherein said ion barrier membrane is composed of multiple atomic layers containing graphene.

3. Electron multiplying structure according to claim 1, wherein said at least one atomic layer solely contains graphene.

4. Electron multiplying structure according to claim 1, wherein an ion barrier membrane is placed at the output face of the electron multiplying structure.

5. Electron multiplying structure according to claim 1, wherein said electron multiplying structure is arranged to support the entrance window of the vacuum tube.

6. An vacuum tube using electron multiplying having a photocathode capable of releasing electrons into said vacuum chamber when exposed to light, electric field means for accelerating said released electrons from said photocathode towards an anode spaced apart from said photocathode in a facing relationship, as well as an electron multiplying structure according to claim 1 disposed in said vacuum chamber between said photocathode and said anode.

7. An vacuum tube using electron multiplying according to claim 6, wherein said photocathode is composed from one or more materials contained in columns III and/or V of the periodic table of elements.

8. An vacuum tube using electron multiplying according to claim 6, wherein said vacuum tube is constructed as an image intensifier tube.

9. An vacuum tube using electron multiplying according to claim 6, wherein said vacuum tube is constructed as a photo multiplier tube.

10. An vacuum tube using electron multiplying according to claim 6, wherein said vacuum tube is constructed as a channeltron.

11. An vacuum tube using electron multiplying according to claim 6, wherein said vacuum tube is constructed as a microchannel plate detector.

12. An ion barrier membrane for shielding off stray ions in an electron multiplying structure being constructed as a microchannel plate for use in a vacuum tube using electron multiplying, the electron multiplying structure comprising:

an input face intended to be oriented in a facing relationship with an entrance window of the vacuum tube; and an output face intended to be oriented in a facing relationship with a detection surface of the vacuum tube, wherein said ion barrier member is composed of at least one atomic layer of graphene and said ion barrier membrane is placed at the input face of the electron multiplying structure.

* * * * *